US011638495B2

(12) United States Patent
Deaton

(10) Patent No.: US 11,638,495 B2
(45) Date of Patent: May 2, 2023

(54) ORAL MOTOR SPOON

(71) Applicant: Ashley Deaton, Salisbury, NC (US)

(72) Inventor: Ashley Deaton, Salisbury, NC (US)

( * ) Notice: Subject to any disclaimer, the term of this patent is extended or adjusted under 35 U.S.C. 154(b) by 0 days.

(21) Appl. No.: 17/344,364

(22) Filed: Jun. 10, 2021

(65) Prior Publication Data

US 2022/0395121 A1 Dec. 15, 2022

(51) Int. Cl.
*A47G 21/04* (2006.01)

(52) U.S. Cl.
CPC ..... *A47G 21/04* (2013.01); *A47G 2200/04* (2013.01); *A47G 2400/10* (2013.01)

(58) Field of Classification Search
CPC ..... A47G 21/00; A47G 21/04; A47G 21/045; A47G 2200/04; A47G 2200/046; A47G 2200/048; A47J 43/28; A47J 43/281; A47J 43/282; A61J 7/0023
USPC ..... 30/149, 150, 324–328; D7/653
See application file for complete search history.

(56) References Cited

U.S. PATENT DOCUMENTS 201,369 A * 3/1878 Walker ..... B26B 11/00 30/325
D21,895 S * 10/1892 Heinz ..... D7/653
D23,196 S * 4/1894 Rockwell ..... D7/653
D24,197 S * 4/1895 Nye ..... D7/653
D25,852 S * 8/1896 Shriver ..... D7/653
621,944 A * 3/1899 Ring ..... A61J 7/0023 30/326
D30,651 S * 5/1899 Schmitt ..... D7/653
742,685 A * 10/1903 Leach ..... A47G 21/02 30/150
834,028 A * 10/1906 Smith ..... A47G 21/04 30/325
D39,250 S * 4/1908 Seib ..... D7/653
D52,688 S * 11/1918 Westbrook ..... 30/326
D67,759 S * 7/1925 Meehan ..... 30/326
1,819,191 A * 8/1931 Mock ..... A47G 21/04 30/328
1,984,081 A * 12/1934 Pisculli ..... A47G 21/04 30/324
D95,949 S * 6/1935 Dunkelberger ..... D7/653
D148,911 S * 3/1948 Comeau ..... 30/324
D167,580 S * 8/1952 McFarland ..... 30/324
2,640,263 A 6/1953 Dieterich
D176,160 S * 11/1955 Seibert, Jr. ..... D7/653
D176,251 S * 12/1955 Desmond, Jr. ..... D7/653
2,803,059 A 8/1957 Murdock et al.
2,810,957 A * 10/1957 Nelson ..... A47G 21/02 30/324
3,014,277 A 12/1961 Geckler
D192,299 S * 2/1962 Wolf et al. ..... D7/653
(Continued)

*Primary Examiner* — Jason Daniel Prone
(74) *Attorney, Agent, or Firm* — Southeast IP Group; Thomas L. Moses

(57) ABSTRACT

An oral motor spoon for improving oral motor skills includes a handle attached to a bowl section that forms a forwardly-sloped concave bowl that curves sharply upwardly to a vertical plane adjacent the tip. The underside of the bowl section preferably includes a series of linear, textured ridges running transversely in parallel relation thereacross. The tip of the bowl section is preferably formed into a generally flat exterior edge in a vertical plane, and the upper horizontal edge of the tip is preferably elevated above than the remaining perimeter of the bowl.

4 Claims, 2 Drawing Sheets

(56) References Cited

U.S. PATENT DOCUMENTS 3,054,184 A * 9/1962 Wyner et al. ..... A61J 7/0023 D7/653
D194,402 S * 1/1963 Schlessel ..... 30/325
3,224,091 A * 12/1965 Scigliana ..... A47J 43/281 30/324
D203,690 S * 2/1966 Smith ..... D7/653
4,425,711 A * 1/1984 Wood ..... A47G 21/04 30/324
4,524,513 A 6/1985 Intini, Jr.
D339,964 S * 10/1993 Knox ..... D7/653
5,697,160 A * 12/1997 Pritsker ..... A47G 21/026 D7/663
D402,857 S * 12/1998 Roberts ..... D7/653
D412,813 S * 8/1999 Roskind ..... D7/653
6,408,521 B1 * 6/2002 Pye ..... A47J 43/281 30/324
6,490,796 B1 * 12/2002 Armienta ..... A47J 43/284 30/325
D523,299 S 6/2006 Johnson
D536,934 S 2/2007 Huber
D552,431 S * 10/2007 Chou ..... A47J 43/281 D7/653
D554,440 S * 11/2007 Malcolm ..... A47G 21/04 D7/653
D554,441 S * 11/2007 Malcolm ..... A47G 21/04 D7/653
D622,784 S * 8/2010 Cohen ..... A47G 21/04 D7/656
D655,979 S * 3/2012 Bolgert ..... A47J 43/281 D7/653
D661,163 S * 6/2012 Reeb ..... A61J 7/0023 D7/653
D705,019 S * 5/2014 Hardy ..... A47J 43/284 D7/653
8,857,065 B2 10/2014 Behbehani
D732,902 S * 6/2015 Ebli ..... D7/653
D739,186 S * 9/2015 Humphreys ..... A47G 21/02 D7/653
D744,300 S 12/2015 Genatossio et al.
D782,255 S 3/2017 Humphreys
D840,768 S * 2/2019 Rupp ..... D7/653
D864,674 S * 10/2019 Iqnaibi ..... D7/653
D871,169 S * 12/2019 Malcolm ..... D7/653
D906,768 S * 1/2021 Braidotti ..... A47G 21/02 D7/653
D937,051 S * 11/2021 Lowsky ..... D7/653
2004/0064952 A1 * 4/2004 Armienta ..... A47J 43/284 30/325
2005/0091854 A1 5/2005 Johnson
2006/0191146 A1 * 8/2006 Chao ..... A47G 21/04 30/324
2006/0288589 A1 * 12/2006 Verona ..... A47G 21/02 30/324
2007/0251103 A1 11/2007 Rhodes, III
2010/0206885 A1 * 8/2010 Bowden ..... A47G 21/04 30/327
2012/0297629 A1 11/2012 Behbehani
2013/0125402 A1 5/2013 Chubenko et al.
2014/0130359 A1 5/2014 Gonterman et al.
2014/0245618 A1 * 9/2014 Wood ..... A47G 21/04 30/324
2016/0296052 A1 10/2016 Hardy et al.
2016/0324347 A1 11/2016 Schmid
2021/0247222 A1 * 8/2021 Wechsler ..... A47G 21/04

* cited by examiner

ORAL MOTOR SPOON

BACKGROUND OF THE INVENTION

The present invention relates generally to an eating utensil that improves oral motor skills for people with Down Syndrome, Cerebral Palsy, developmental delay, or other similar conditions. More specifically, the present invention is an oral motor spoon, which is designed to help the user improve oral motor skills.

Many people who are born prematurely or have been diagnosed with Down Syndrome, Cerebral Palsy, or developmental delay have difficulty controlling their tongue movement, lip movement, and have decreased oral awareness. This oral motor spoon includes a thick, flat, blunt, rectangular-shaped tip, a bowl having an inner portion that is sloped downwardly towards the tip, and a longitudinally extending handle. These unique features promote improvement of oral motor skills. This configuration is particularly useful for users to learn where their tongue should be positioned when eating off of a spoon, how their upper lip should move, and to increase oral awareness.

Heretofore, many efforts have been made to provide mechanisms for eating utensils and the like. Some examples are set forth hereinbelow, and each of the following references are incorporated herein by reference, in their entireties:

U.S. Pat. No. 2,640,263-E-Z Feeding Baby Spoon for Liquid or Medicines

This invention relates to spoons especially adapted for feeding liquids to small infants. In the feeding of infants, it is obviously desirable to utilize a spoon which minimizes the possibility of liquid flowing over the sides and also prevents infants from obstructing the passage of fluid from the bowl to the mouth by means of their lips. No adequate solution to this problem is presented by the conventional spoon since a slight tilting of the spoon results in liquid running over the sides soiling clothes and other surrounding objects. Moreover, due to the open type bowl construction, an infant can easily prevent proper feeding by pressing his lips tightly about the spoon surface.

U.S. Pat. No. 2,803,059-Spoon

The present invention relates to a spoon and more particularly to a feeding device which is adapted to administer certain types of nourishment to infants or invalids. Due to the fact that many babies take their milk or formula from a nursing bottle, they are ordinarily unfamiliar with a spoon which is used after a certain period of growth and development. However, babies are ordinarily familiar with the conventional rubber nipple and receive it quite readily. The natural tendency of an infant getting hold of a rubber nipple is to place it in his mouth and suck. The present invention proposes to take advantage of this natural tendency. Another important factor in feeding babies is consideration for the gums which are quite tender and which are easily injured by biting or contacting hard objects.

U.S. Pat. No. 3,014,277-Feeding Spoon

The present invention relates to spoons, and the like, and more particular to a spoon for feeding infants. Conventionally shaped spoons are unsatisfactory for training infants to eat semi-sold foods for the reason that an infant during the first few weeks has not learned to compress its lips to accept and hold food within its mouth. A conventional spoon must be tipped upwardly at the handle end to scrape the food out of the spoon against the infant's upper gum. This action causes the sides of the spoon to contact the infant's gums and, being hard, and an unfamiliar sensation to the infant's mount, the infant tries to reject the spoon by pushing it out of its mouth by pushing its tongue against the spoon and food. A conventional spoon is not shaped properly for efficiently scraping rejected food off an infant's lips and chin to return the food to the mouth. Furthermore, the conventional spoon, formed of metal, hurts the gums of an infant when it bites on the spoon, this is particularly true when the infant is teething.

U.S. Pat. No. 4,524,513-Flat Tip Spoon

A flatware or culinary spoon has a bowl with a rearwardly extending handle and forwardly extending flat tip end area portion. The remainder of the bowl merges with the flat tip end area portion and provides a receptacle for material directed thereinto by the flat tip end area portion. Convexly arcuate side edges of the bowl merge with and terminate a substantial distance rearwardly from the forward portion of the flat tip end area portion, so that the sides of the flat tip portion forwardly from the side edges are free from interference from the forward ends of the side edges. The front edge of the flat tip end area portion may be convexly curvate, straight edge, indented or multi-lobed.

U.S. Pat. No. 8,857,065-Training Spoon

A training spoon for training an individual not to bite down on a spoon includes a longitudinally extending handle and a spoon shaped head portion integral with or attached to the handle. The head portion defines a relatively shallow concave bowl with a plurality of generally parallel alternating transverse ridges and adjacent grooves extending across a majority of the width of the head portion of the spoon.

U.S. Pub. No. 2005/0091854-Apparatus and Methods for Providing Oral Tactile Stimulation while Delivering Food A transitional feeding tool for individuals with oral sensory problems comprises a handle and a food-carrying platform carries by the handle. The food-carrying platform has a top surface and a bottom surface extending along an axis and at least one blunt projection extending radially from the bottom surface of the platform. The projection is adapted to contact the tongue to provide oral tactile stimulation as the tool is advanced over the tongue to deliver food.

U.S. Pub. No. 2007/0251103-Baby Spoon

A baby spoon has a handle and a bowl connected to the handle. The bowl has laterally spaced side edges, a back edge extending generally transversely between the side edges, and front edge longitudinally spaced from the back edge and extending transversely between the side edges of the bowl. The front edge includes a forward most extend of the bowl and has a smallest radius of curvature of not less than about 0.75 inches. The side edges define a bowl width including a maximum bowl width. The bowl width decreases from the maximum forward to the front edge of the bowl. The longitudinal distance between the maximum bowl width and the forward most extent of the bowl is no more than about 0.75 inches. In another embodiment, the maximum width of the bowl is nearer to the front edge of the bowl than to the back edge of the bowl.

U.S. Pub. No. 2012/0297629-Training Spoon

A training spoon for training an individual not to bite down on a spoon includes a longitudinally extending handle and a spoon shaped head portion integral with or attached to the handle. The head portion defines a relatively shallow concave bowl with a plurality of generally parallel alternating transverse ridges and adjacent grooves extending across a majority of the width of the head portion of the spoon.

U.S. Pub. No. 2013/0125402-Feeding Utensil

Utensils including a cover for at least a portion of the working end of the utensil. The cover may be in the form of a "scoop" located at the rearward portion of the working end of a utensil so that a user, such as a child, may lift the utensil vertically and still avoid spilling a significant portion of the food. The utensil may include a handle having a handle portion thicker than a conventional child utensil handle. The handle may be curved for easier handling. The cover may include indicia such as a character appealing to a user, such as a cartoon, animated character, celebrity or the like.

U.S. Pub. No. 2014/0130359-Personal Food Delivery Apparatus and Method

A personal food delivery apparatus and method includes a utensil with a handle end and a food end where the food end is a flat surface. A food retaining device is connected with the food end where the food retaining device retains food of the food retaining device.

U.S. Pub. No. 2016/0296052-Spoon

A spoon is provided that has a handle, a neck, a head, and a spoon or food receiving recess that has a front edge and a rear edge. The rear edge is raised such that a straight line joining the front edge and the rear edge extends in the same general direction as a straight line extending in the general direction of the length of the handle of the spoon. Preferably, the neck is spaced from the spoon or food receiving recess by a distance of the same order as the dimension of the recess itself. The cross-sectional size of the spoon increases from the neck to a position corresponding to the rear edge of the recess with the outer surface being smoothly contoured to provide a smooth contact surface for the lips of a person using same to encircle the spoon between the neck and recess.

U.S. Pub. No. 2016/0324347-Spoon with Retention Means

The present invention comprises a spoon (1) with a handle (2) and a rigid central base region (3), wherein the rigid central base region (3) merges at its periphery into an extended portion, which, in the resting condition forms a retaining edge (5) inclined inwards relative to a vertical axis (4), and wherein the retaining edge (5) is embodied to be foldable inwards relative to the base region (3).

U.S. Design Pat. No. D523,299-Textured Spoon

U.S. Design Pat. No. D536,934-Spoon with Orifices

U.S. Design Pat. No. D744300-Slotted Head Spoon with Silicone End

U.S. Design Pat. No. D782,255-Yogurt Spoon

BRIEF SUMMARY OF THE INVENTION

In accordance with one aspect of the invention, a first embodiment of an oral motor spoon for improving oral motor skills includes a handle, with a first end and a second end, that extends longitudinally, and bowl section having an interior that defines a forwardly-sloped concave bowl. The bowl section is connected to the second end of the handle and an interior portion of the bowl slopes from the handle, downwardly towards the tip, which is positioned at a distal end of the bowl.

The tip preferably includes a flat, vertically oriented exterior edge, and is thick, blunt, and elevated above the remaining perimeter of the bowl so that as the user places the spoon into his or her mouth, it pushes the user's tongue back into the user's mouth, training the user where his or her tongue should be when eating from a spoon.

The interior portion of the bowl section is sloped downwardly towards the tip to provide touch to the upper lip when the spoon enters the user's mouth, allowing the user to learn how his or her upper lip should move when eating from a spoon. The distal end of the bowl section includes, on an inner surface thereof, a sharp upward curve toward a vertically oriented interior edge adjacent the tip, so that food carried within the bowl tends to gravitate toward the tip of the spoon. The bowl section preferably widens in a transverse direction as it extends from the handle to the tip.

The underside surface of the bowl section is generally flat, disposed in a generally horizontal plane. Additionally, the underside of the bowl section includes parallel, linear, textured ridges oriented transversely with respect to the handle. As a user places the spoon into his or her mouth, the ridges rub along the user's lower lip, increasing oral awareness and providing stimulation to the lower lip, indicating that the user should move his or her lip upwardly to cup the bottom of the bowl of the spoon.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
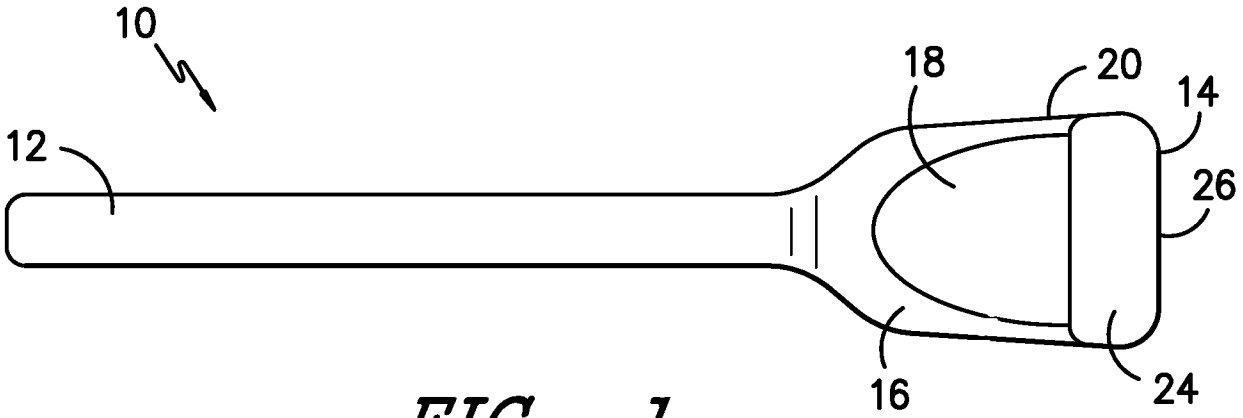
FIG. 1 is a top view of one embodiment of the oral motor spoon, wherein the oral motor spoon has a handle, a bowl section forming a generally concave bowl, and a thick, blunt, rectangular-shaped tip at a distal end thereof.

The present invention includes, in a first embodiment, an oral motor spoon 10, as shown in FIGS. 1-5, and includes a handle 12 with a first end a second end, a thick, flat, blunt tip 14, and bowl section 16 including forwardly-sloped concave bowl 18. The handle 12 extends longitudinally, and the bowl section 16 extends from the second end of the handle 12, widening as toward the tip 14, which is positioned on the distal end 20 of the bowl 18.

Figure 2:
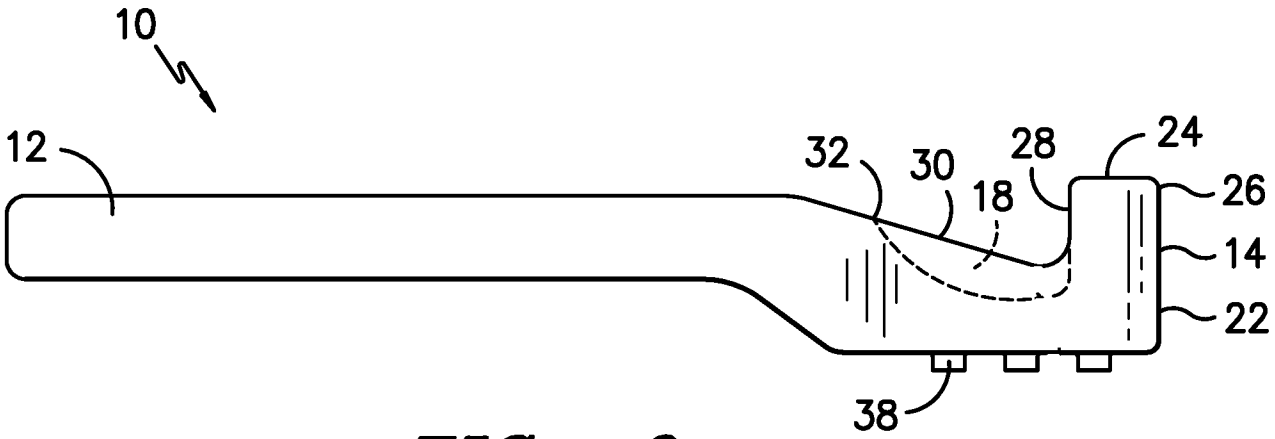
FIG. 2 is a side view of one embodiment of the oral motor spoon, wherein the oral motor spoon includes bowl section forming a forwardly-sloped concave bowl and textured ridges running transversely along an underside thereof, and wherein the dashed lines indicate the shape of the inner surface of the bowl.
Figure 4:
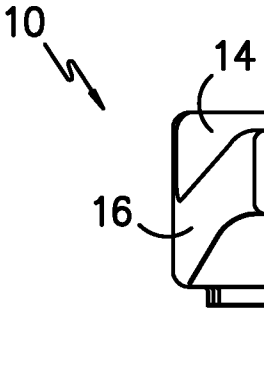
FIG. 4 is a rear view of one embodiment of the oral motor spoon, wherein an upper surface of the flat tip of the bowl section extends above the remaining upper perimeter the concave bowl.
Figure 5:
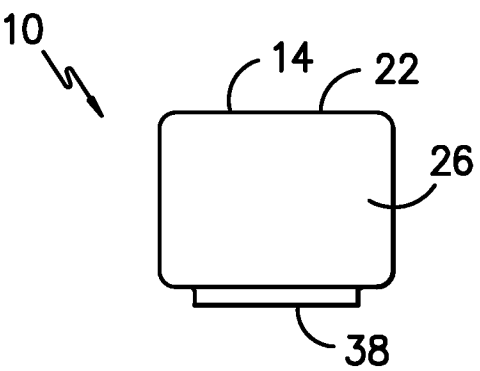
FIG. 5 is a perspective front view of one embodiment of the oral motor spoon, wherein the front exterior portion of the tip is a smooth, flat, tip having a generally rectangular cross-section.

In a preferred embodiment, the tip 14 is formed into a flat, thick, blunt, rectangular-shaped section 22 that is positioned in a generally vertical plane in relation to the generally horizontally oriented handle 12. The upper edge 24 of the tip 14 is preferably flat, and is elevated above the remaining perimeter of the spoon 10, as shown in FIGS. 2 and 4. The width of the upper edge 24 of the tip 14 in a longitudinal direction, between the front edge 26 of the tip 14 and the distal end 28 of the interior, generally vertical, bowl surface 48 is preferably between 1.0 and 1.25 inches, although other widths may be suitable. When in use, this flat tip 14 pushes the user's tongue back into the user's mouth as the spoon enters the user's mouth. The interior portion 30 of the bowl section 16 is preferably positioned such that it slopes downwardly from the handle 12 towards the tip 14, at roughly a 45 degree angle 32 (preferably between 40-50 degrees), and curves sharply into a vertical plane 4 adjacent the tip 14. This unique slope 32 of the bowl 18 tends to urge food held therein to gravitate toward the tip 14. The bowl shape provides touch to the user's upper lip when the spoon 10 enters the user's mouth and allows the user's upper lip to slide down when clearing the bowl 18 of the spoon 10, which aids the user in learning how his or her upper lip should move when eating off of a spoon. Additionally, the bowl 18 includes a concave shape such that a user can hold liquids and other types of food in the bowl 18 of the spoon 10.

Figure 3:
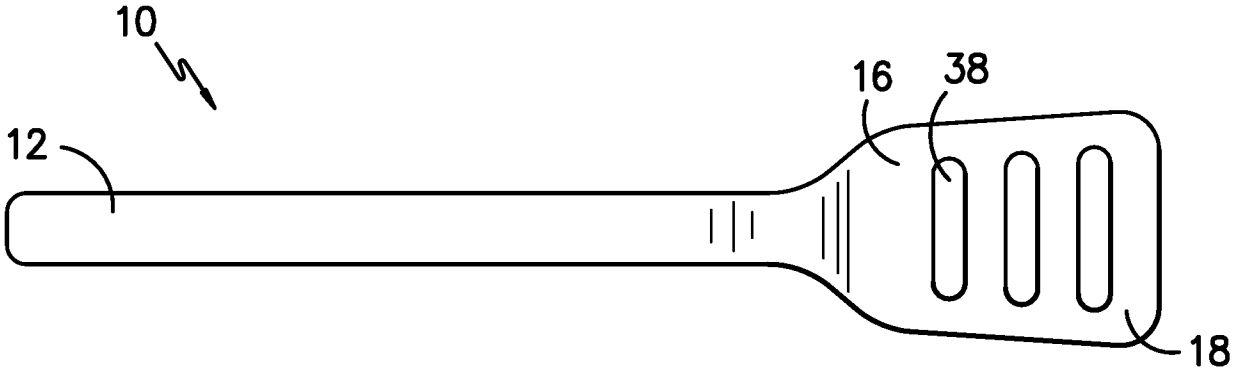
FIG. 3 is a bottom view of one embodiment of the oral motor spoon, wherein the oral motor spoon includes three textured ridges in parallel relation, running transversely along the underside of the bowl.

In a preferred embodiment, the bowl section 16 includes three textured ridges 38 extending horizontally and transversely in parallel relation along an underside thereof, as shown in FIGS. 2 and 3. The ridges 38 are preferably narrower than the width of the underside of the bowl section 16, so that they do not extend to each exterior side of the bowl 18, as shown. As the spoon 10 enters the user's mouth, the ridges 38 rub along the user's lower lip, increasing oral awareness, and provide stimulation to the lower lip, training user's to cup the bottom of the bowl 18 of the spoon 10 with his or her lower lip.

In one embodiment, the tip 14 may include a rounded edge on the upper portion of the tip, instead of the generally rectangular-shaped tip discussed previously.

Preferably, the oral motor spoon 10 is made of food grade silicone or other similar materials, but it should be understood that any suitable food grade material may be used.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. An oral motor spoon for improving motor skills, comprising:

a handle with a first end and a second end, wherein said handle extends in a longitudinal direction;

a bowl section having a first end and a second end, said first end of said bowl section extending from said second end of said handle, and said second end of said bowl section forming a tip of said spoon, said tip including a generally horizontal, flat upper surface and terminating in a generally vertical, flat exterior front surface;

said bowl section having an upper perimeter and including an interior surface that slopes downwardly from said first end of said bowl section and curves upwardly into a generally vertical plane from a bottom of said interior bowl surface to said perimeter of said bowl section at said tip;

wherein said bowl section is wider at said tip than said first end thereof, said bowl section includes a generally horizontal bottom exterior surface; and said generally horizontal, flat upper surface of said tip defines a portion of said perimeter wherein said generally horizontal, flat upper surface is raised above a remaining portion of said perimeter.

2. The oral motor spoon set forth in claim 1, wherein said bowl section further includes a plurality of textured ridges extending in parallel relation along said bottom exterior surface thereof.

3. The oral motor spoon set forth in claim 1, wherein said spoon is made of food grade silicone.

4. The oral motor spoon set forth in claim 1, wherein said interior surface of said bowl section slopes downwardly in a direction from said first end of said bowl section toward said tip at an angle in the range of between 40 degrees and 50 degrees.

* * * * *